US006661898B2

(12) United States Patent
Kuwabara

(10) Patent No.: US 6,661,898 B2
(45) Date of Patent: Dec. 9, 2003

(54) SPEAKER FOR AN ELECTRONIC INSTRUMENT

(75) Inventor: Atsushi Kuwabara, Yamanashi-ken (JP)

(73) Assignee: Citizen Electronics Co., Ltd., Yamanashi-ken (JP)

( * ) Notice: Subject to any disclaimer, the term of this patent is extended or adjusted under 35 U.S.C. 154(b) by 0 days.

(21) Appl. No.: 10/067,830

(22) Filed: Feb. 8, 2002

(65) Prior Publication Data

US 2002/0114473 A1 Aug. 22, 2002

(30) Foreign Application Priority Data

Feb. 16, 2001 (JP) ..... 2001-040983

(51) Int. Cl.[7] ..... H04R 1/02
(52) U.S. Cl. ..... 381/87; 381/391; 381/189
(58) Field of Search ..... 381/87, 152, 400, 381/401, 407, 423, 431, 391, 396, 433, 189

(56) References Cited

U.S. PATENT DOCUMENTS 5,181,253 A * 1/1993 Jordan ..... 381/184
6,404,896 B1 * 6/2002 Yoo ..... 381/401

* cited by examiner

*Primary Examiner*—Minsun Oh Harvey
(74) *Attorney, Agent, or Firm*—Dennison, Schultz & Dougherty

(57) ABSTRACT

A speaker comprises a lower frame assembly and an upper frame assembly. The lower frame assembly comprises a lower frame provided with a yoke, a permanent magnet secured to the yoke, and a top plate secured to the permanent magnet. The upper frame assembly comprises an upper frame provided with a diaphragm secured to the upper frame, and a voice coil secured to the diaphragm and disposed in a magnetic gap between the yoke and the top plate. A plurality of axial grooves are formed in a peripheral wall of the lower frame, and a plurality of engaging portions are formed on the upper frame, corresponding to the grooves of the lower frame. Each of the engaging portions comprises an engaging plate and a hook formed at an end of the engaging plate.

2 Claims, 3 Drawing Sheets

SPEAKER FOR AN ELECTRONIC INSTRUMENT

BACKGROUND OF THE INVENTION

The present invention relates to a speaker for an electronic instrument such as a portable telephone.

In recent years, there is used a thin electrodynamic speaker having an excellent quality for the portable telephone. Dimensions of parts in the speaker, in particular, position accuracy of the voice coil disposed in the magnetic circuit have an influence on sound quality. Therefore, it is necessary to severely check the position accuracy.

A conventional speaker will be described hereinafter with reference to FIGS. 4 and 5.

The speaker comprises a lower frame assembly 51 and an upper frame assembly 52.

The lower frame assembly 51 comprises an annular lower frame 61 made of plastic, a tray shape yoke 62 made of magnetic material and embedded in the lower frame, a permanent magnet 63 secured to the yoke and a top plate 64 made of magnetic material and secured to the permanent magnet 63. A magnetic circuit is formed by the top plate 64, permanent magnet 63 and the yoke 62 to form a magnetic gap 66 between the peripheral wall of the top plate 64 and the inside wall of an upper portion of the yoke 62.

On the upper surface of the lower frame 61, an annular projection 61*a* is formed at a peripheral portion thereof and an annular step 61*b* is formed outside the projection 61*a*.

The upper frame assembly 52 comprises an annular upper frame 71 made of plastic, a diaphragm 73, a voice coil 74 secured to the underside of the diaphragm 73, and a protector 75 having a plurality of sound discharge openings. A pair of leads 72 are embedded in the upper frame 71 and projected from the upper frame and downwardly bent.

The upper frame 71 has an annular upper step 71*a* on the upper surface thereof, and an annular lower step 71*b*. The diaphragm 73 is adhered to the lower step 71*b* and the protector 75 is adhered to the upper step 71*a*.

Both ends 74*a* of the voice coil 74 are projected from the upper frame 71 passing through holes formed in the frame and connected to the leads 72, respectively.

FIG. 5 shows both the lower and upper frame assemblies 51 and 52.

The upper frame 71 is secured to the step 61*b* of the lower frame 61 by the ultrasonic welding, so that the voice coil 74 is disposed in the magnetic gap 66.

In order to allow the vibration of one of the frame assemblies in the ultrasonic welding operation, there is provided a clearance B between the inside wall of the upper frame 71 and the outside wall of the projection 61*a* of the lower frame 61. However, the clearance (0.05–0.1 mm) causes central positions of the lower and upper frames 61 and 71 to deviate from each other when both frame assemblies are coupled with each other. As a result, the position of the voice coil 74 is not accurately positioned in the magnetic gap 66, so that the sound quality of the speaker deteriorates.

SUMMARY OF THE INVENTION

An object of the present invention is to provide a speaker in which the voice coil can be accurately positioned in the magnetic gap.

According to the present invention, there is provided a speaker for an electronic instrument comprising a lower frame assembly comprising a lower frame provided with a yoke, a permanent magnet secured to the yoke, and a top plate secured to the permanent magnet, an upper frame assembly comprising an upper frame provided with a diaphragm secured to the upper frame, and a voice coil secured to the diaphragm and disposed in a magnetic gap between the yoke and the top plate, wherein a plurality of grooves are formed in a peripheral wall of the lower frame, a plurality of engaging portions are formed on the upper frame, corresponding to the grooves of the lower frame, each of the engaging portions comprises an engaging plate and a hook formed at an end of the engaging plate.

Each of the engaging portions comprises an elastic engaging plate axially projected from an underside of the upper frame, and a hook formed at an end of the elastic engaging plate so as to be engaged with an underside of the lower frame.

These and other objects and features of the present invention will become more apparent from the following detailed description with reference to the accompanying drawings.

DETAILED DESCRIPTION OF THE PREFERRED EMBODIMENT

Figure 1:
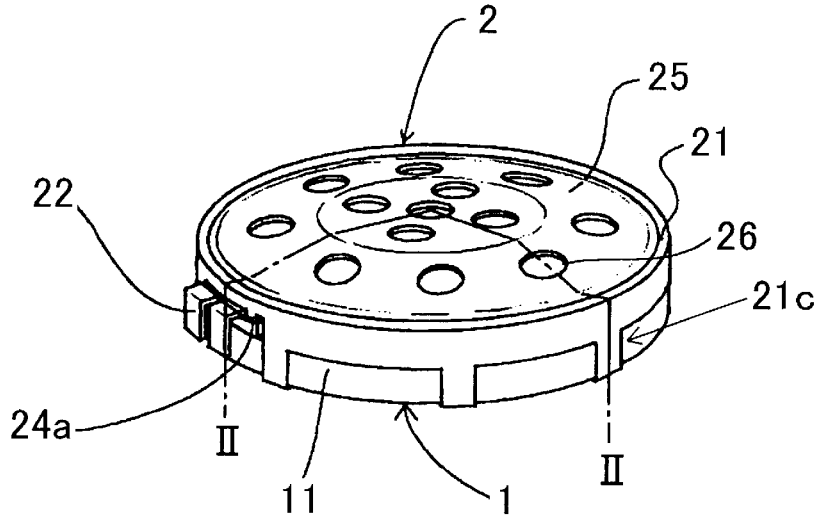
FIG. 1 is a perspective view of a speaker of the present invention.
Figure 2:
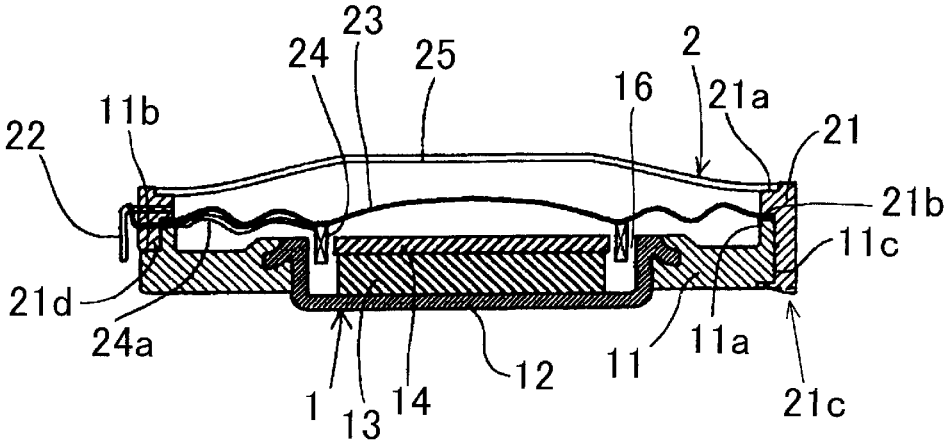
FIG. 2 is a sectional view taken along a line II—II of FIG. 1.
Figure 3:
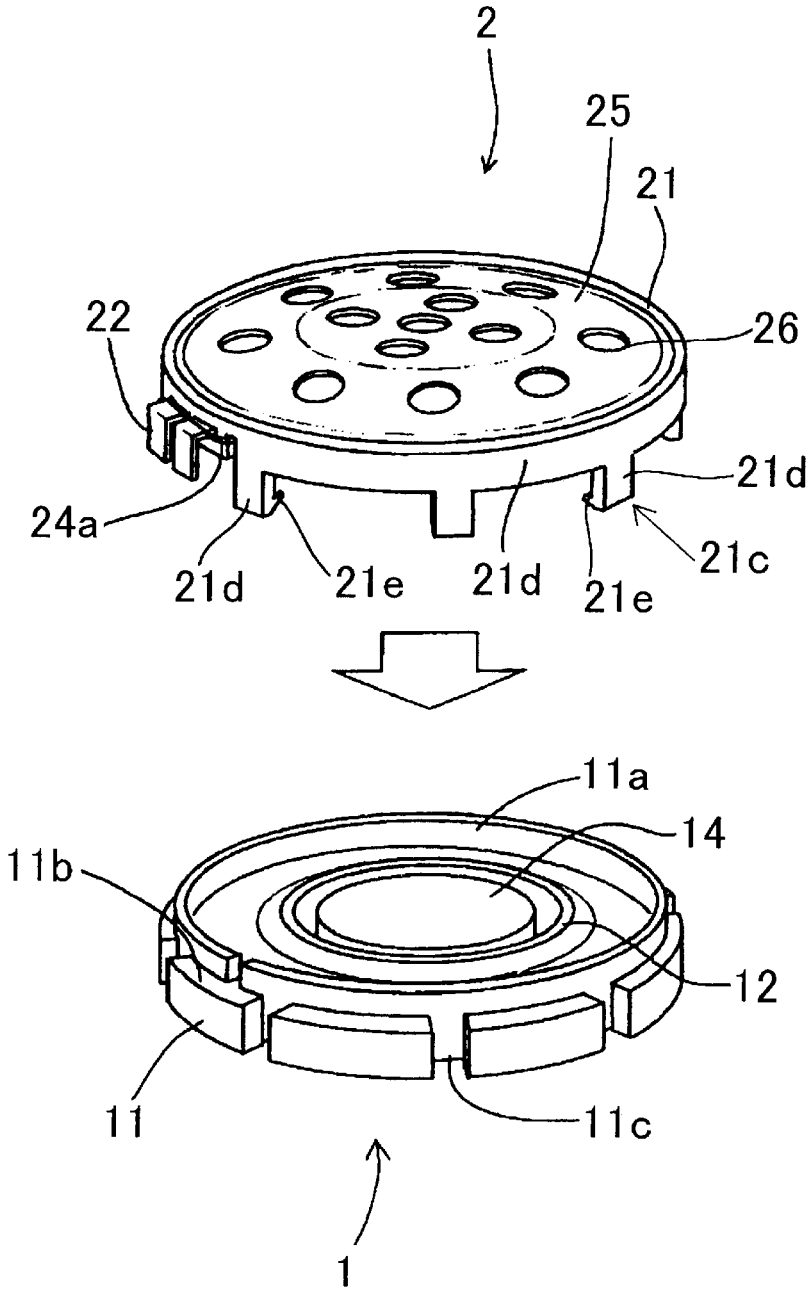
FIG. 3 is an exploded perspective view of the speaker.
Figure 4:
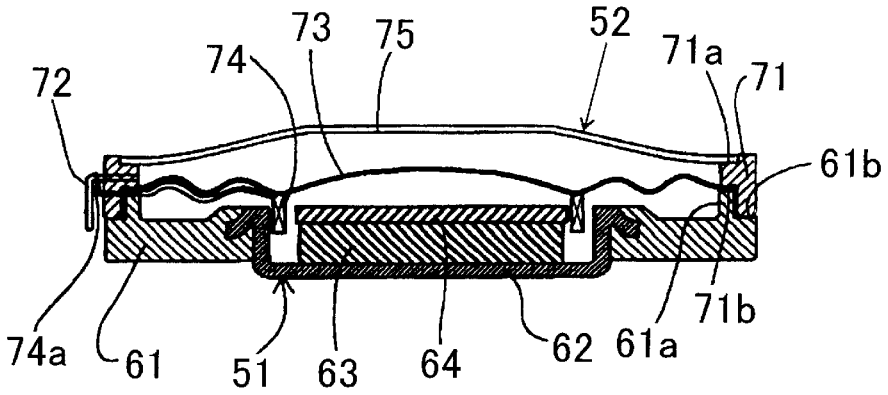
FIG. 4 PRIOR ART
FIG. 4 is a sectional view of a conventional speaker.
Figure 5:
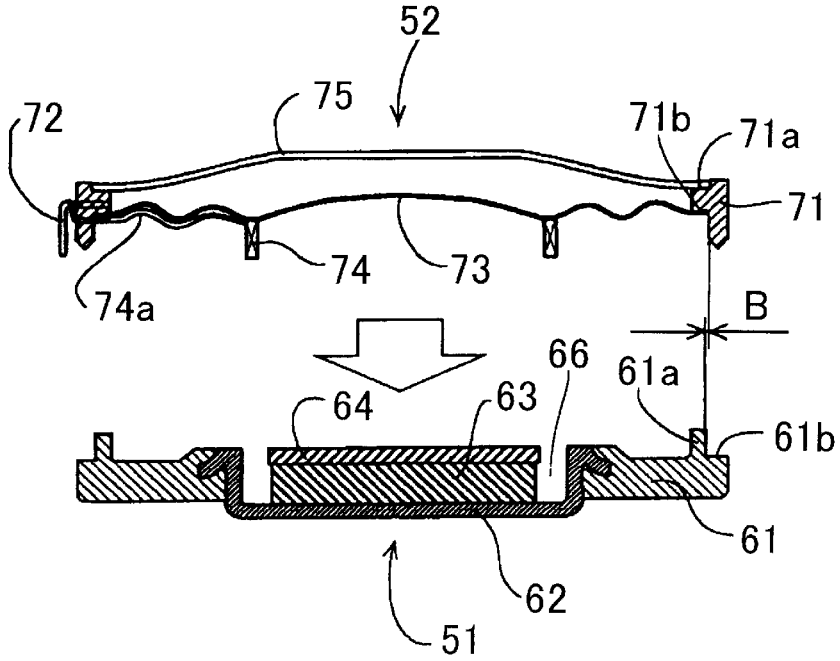
FIG. 5 PRIOR ART
FIG. 5 is an exploded sectional view of the speaker.

Referring to FIGS. 1 through 3, the speaker of the present invention comprises a lower frame assembly 1 and an upper frame assembly 2.

The lower frame assembly 1 comprises an annular lower frame 11 made of plastic, a tray shape yoke 12 made of magnetic material and embedded in the lower frame 11, a permanent magnet 13 secured to the yoke 12 and a top plate 14 made of magnetic material and secured to the permanent magnet 13. A magnetic circuit is formed by the top plate 14, permanent magnet 13 and the yoke 12 to form a magnetic gap 16 between the peripheral wall of the top plate 14 and the inside wall of an upper portion of the yoke 12.

On the upper surface of the lower frame 11, an annular projection 11*a* is formed at a peripheral portion thereof and an annular step 11*b* is formed outside the projection 11*a*.

In the present invention, a plurality of axial grooves 11*c* are formed in the lower frame 11 at the peripheral wall thereof so that the bottom of the groove becomes coplanar with the outer surface of the projection 11*a*.

The upper frame assembly 2 comprises an annular upper frame 21 made of plastic, a diaphragm 23, a voice coil 24 secured to the underside of the diaphragm 23, and a protector 25 having a plurality of sound discharge openings 26. A pair of leads 22 are embedded in the upper frame 21 and projected from the upper frame and downwardly bent.

The upper frame 21 has an annular upper step 21*a* on the upper surface thereof, and an annular lower step 21*b*.

The diaphragm 23 is adhered to the lower step 21*b* and the protector 25 is adhered to the upper step 21*a*.

Both ends 24*a* of the voice coil 24 are projected from the upper frame 21 passing through holes formed in the frame and connected to the leads 22, respectively.

A plurality of engaging portions 21*c* are axially and downwardly projected from the underside of the upper frame 21 corresponding to the grooves 11*c*.

Each of the engaging portions 21*c* comprises an elastic engaging plate 21*d* and a hook 21*e* formed at the lower end of the engaging plate 21*d* so as to be engaged with the underside of the lower frame 11. The elastic engaging plate 21*d* and the hook 21*e* are provided to be engaged with the bottom of the groove 11*c* without a gap there-between or with a very small gap of 0.01–0.05 mm.

In coupling of both frame assemblies 1 and 2, the hooks 21*e* are engaged with the grooves 11*c* and downwardly pushed, so that the hook end of each hook 21*e* snugly engages with the underside of the lower frame 11, and each of the elastic engaging plates 21*d* is pressed against the bottom of the groove 11*c*. Thus, both frame assemblies are engaged with each other without welding.

In accordance with the present invention, the lower frame assembly and the upper frame assembly are snugly engaged with each other by the engaging portions 21*c* without gaps there-between. Therefore, the voice coil 24 can be positioned in the magnetic gap 16 at a desired position. Consequently, excellent sound quality can be obtained.

While the invention has been described in conjunction with preferred specific embodiment thereof, it will be understood that this description is intended to illustrate and not limit the scope of the invention, which is defined by the following claims.

What is claimed is:

1. A speaker for an electronic instrument comprising:

a lower frame assembly comprising a lower frame provided with a yoke, a permanent magnet secured to the yoke, and a top plate secured to the permanent magnet; and an upper frame assembly comprising an upper frame provided with a diaphragm secured to the upper frame, and a voice coil secured to the diaphragm and disposed in a magnetic gap between the yoke and the top plate, wherein a plurality of grooves are formed in a peripheral wall of the lower frame;

a plurality of engaging portions are formed on the upper frame, corresponding to the grooves of the lower frame; and each of the engaging portions comprises an engaging plate and a hook formed at an end of the engaging plate, so that the engaging plate and the hook are engaged with a corresponding groove, thereby engaging the lower frame assembly with the upper frame assembly.

2. The speaker according to claim 1 wherein each of the engaging portions comprises an elastic engaging plate axially projected from an underside of the upper frame, and a hook formed at an end of the elastic engaging plate so as to be engaged with an underside of the lower frame.

* * * * *